US010240610B2

(12) United States Patent
Kelly et al.

(10) Patent No.: US 10,240,610 B2
(45) Date of Patent: Mar. 26, 2019

(54) TURBOCHARGER PURGE SEAL INCLUDING AXISYMMETRIC SUPPLY CAVITY

(71) Applicant: BorgWarner Inc., Auburn Hills, MI (US)

(72) Inventors: Allan D. Kelly, Hendersonville, NC (US); E. Perry Ellwood, Saluda, NC (US); Zachary Ashton, Arden, NC (US); Robert T. Race, Arden, NC (US)

(73) Assignee: BorgWarner Inc., Auburn Hills, MI (US)

( * ) Notice: Subject to any disclaimer, the term of this patent is extended or adjusted under 35 U.S.C. 154(b) by 502 days.

(21) Appl. No.: 14/905,452

(22) PCT Filed: Jul. 18, 2014

(86) PCT No.: PCT/US2014/047116

§ 371 (c)(1),
(2) Date: Jan. 15, 2016

(87) PCT Pub. No.: WO2015/013114

PCT Pub. Date: Jan. 29, 2015

(65) Prior Publication Data

US 2016/0160872 A1 Jun. 9, 2016

Related U.S. Application Data

(60) Provisional application No. 61/858,978, filed on Jul. 26, 2013.

(51) Int. Cl.
*F04D 29/10* (2006.01)
*F01D 25/16* (2006.01)
(Continued)

(52) U.S. Cl.
CPC ..... *F04D 29/10* (2013.01); *F01D 11/04* (2013.01); *F01D 25/16* (2013.01); *F01D 25/183* (2013.01);
(Continued)

(58) Field of Classification Search
CPC ..... F04D 29/10; F04D 29/102; F04D 29/104; F04D 29/124; F04D 29/624;
(Continued)

(56) References Cited

U.S. PATENT DOCUMENTS 3,360,239 A * 12/1967 Swearingen ..... F01D 11/04 277/347
3,909,012 A * 9/1975 Denis ..... F01D 11/04 277/432
(Continued)

FOREIGN PATENT DOCUMENTS

| | | | |
|---|---|---|---|
| JP | 2004116514 | A | 4/2004 |
| JP | 201019253 | A | 1/2010 |
| WO | 2013106303 | A1 | 7/2013 |

OTHER PUBLICATIONS

Chinese Office Action (with English language translation) dated Nov. 3, 2017, in Chinese Application No. 201480040157.5.
(Continued)

*Primary Examiner* — Aaron R Eastman
(74) *Attorney, Agent, or Firm* — Eric L. Doyle; Stephan A. Pendorf; Patent Central LLC

(57) ABSTRACT

A turbocharger rotating assembly (125) includes a shaft (20) rotatably supported in a bearing housing (123) via bearings (26, 128), a compressor impeller (18) mounted on the shaft (20), and an oil flinger (122) disposed on the shaft (20) between the bearings (26, 128) and the compressor impeller (18). The turbocharger (100) further includes an insert (134) disposed in the shaft-receiving axial bore (120) so as to
(Continued)

surround the oil flinger (122), and a purge seal (160) operatively positioned in an interface (131) between the insert (134) and the oil flinger (122), whereby the purge seal (160) is configured to minimize oil passage from the bearing housing (123) into the interface (131). An annular cavity (150) encircles the radially outward-facing surface (138) of the insert (134), the cavity (150) forming a portion of a fluid path configured to deliver pressurized fluid to the interface (131).

13 Claims, 11 Drawing Sheets

(51) Int. Cl.

| | |
|---|---|
| ***F01D 25/18*** | (2006.01) |
| ***F04D 29/12*** | (2006.01) |
| ***F04D 29/62*** | (2006.01) |
| ***F01D 11/04*** | (2006.01) |
| ***F02B 33/32*** | (2006.01) |
| ***F02B 39/14*** | (2006.01) |
| *F04D 25/02* | (2006.01) |

(52) U.S. Cl.
CPC ..... *F02B 33/32* (2013.01); *F02B 39/14* (2013.01); *F04D 29/102* (2013.01); *F04D 29/104* (2013.01); *F04D 29/124* (2013.01); *F04D 29/624* (2013.01); *F04D 25/024* (2013.01); *F05D 2220/40* (2013.01); *F05D 2240/55* (2013.01)

(58) Field of Classification Search
CPC ..... F04D 25/024; F01D 11/04; F01D 25/16; F01D 25/183; F02B 33/32; F02B 39/14; F05D 2220/40; F05D 2240/55
USPC ..... 415/170.1
See application file for complete search history.

(56) References Cited

U.S. PATENT DOCUMENTS

| | | | | |
|---|---|---|---|---|
| 3,966,351 | A * | 6/1976 | Sproule | F01D 11/04 415/110 |
| 4,343,591 | A | 8/1982 | Hannan et al. | |
| 7,544,039 | B1 * | 6/2009 | Pelfrey | F01D 5/085 415/168.4 |
| 8,474,433 | B2 | 7/2013 | French | |
| 2005/0188694 | A1 | 9/2005 | Frankenstein | |
| 2005/0193713 | A1 * | 9/2005 | Kovasity | F01D 15/10 60/39.08 |
| 2006/0251512 | A1 * | 11/2006 | Singh | F01D 25/183 415/174.5 |
| 2009/0066033 | A1 * | 3/2009 | Lusted | F01D 11/001 277/411 |
| 2010/0008767 | A1 | 1/2010 | Ward et al. | |
| 2010/0037855 | A1 | 2/2010 | French | |
| 2012/0328418 | A1 | 12/2012 | Yang et al. | |

OTHER PUBLICATIONS

Written Opinion and International Search Report in International Application No. PCT/US2014/047116 dated Nov. 4, 2014.
Japanese Office Action (with English language translation) dated Jun. 21, 2018, in Japanese Application No. 2016-529794.
Chinese Office Action (with English language translation) dated Jul. 23, 2018, in Chinese Application No. 2014870040157.5.

* cited by examiner

TURBOCHARGER PURGE SEAL INCLUDING AXISYMMETRIC SUPPLY CAVITY

CROSS-REFERENCE TO RELATED APPLICATIONS

This application claims priority to, and all the benefits of, U.S. Provisional Application No. 61/858,978, filed on Jul. 26, 2013, and entitled "Turbocharger Purge Seal Utilizing Axisymmetric Volume to Facilitate Supply Gas Passage Fabrication," the entire contents of which are incorporated by reference herein.

BACKGROUND

Turbochargers are provided on an engine to deliver air to the engine intake at a greater density than would be possible in a normal aspirated configuration. This allows more fuel to be combusted, thus boosting the engine's horsepower without significantly increasing engine weight.

Generally, turbochargers use the exhaust flow from the engine exhaust manifold, which enters the turbine stage of the turbocharger at a turbine housing inlet, to thereby drive a turbine wheel, which is located in the turbine housing. The turbine wheel is affixed to one end of a shaft that is rotatably supported within a bearing housing. The shaft drives a compressor impeller mounted on the other end of the shaft. As such, the turbine wheel provides rotational power to drive the compressor impeller and thereby drive the compressor of the turbocharger. This compressed air is then provided to the engine intake as described above.

The compressor stage of the turbocharger comprises the compressor impeller and its associated compressor housing. Filtered air is drawn axially into a compressor air inlet which defines a passage extending axially to the compressor impeller. Rotation of the compressor impeller pressurizes air, creating a radially outward flow from the compressor impeller into the compressor volute for flow to the engine.

Pressure conditions in the turbine stage and compressor stage can often result in oil being drawn through the mechanisms that seal the rotating assembly to the bearing housing. The internal flow of oil from the bearing housing to the compressor stage and engine combustion chamber is generally referred to as "compressor end oil-passage." Compressor-end oil passage is to be avoided as it can result in contamination of the catalysts and unwanted emissions. With ever more stringent emissions standards, the propensity for compressor-end oil passage is becoming a greater issue.

Thus, there is a need for enhanced sealing arrangements between the rotating components and the static components in the compressor-end of a turbocharger, particularly at low turbocharger speeds.

SUMMARY

In some aspects, a sealing system is provided for a turbocharger that includes a bearing housing having an axial bore, a rotating assembly, and an insert. The rotating assembly includes a shaft having axis of rotation, the shaft rotatably supported in the axial bore via bearings, a compressor impeller mounted on the shaft, and an oil flinger disposed on the shaft between the bearings and the compressor impeller. The insert is disposed in the axial bore so as to surround the oil flinger and defining a radially outward-facing surface. The sealing system includes a purge seal operatively positioned in an interface between the insert and the oil flinger. The purge seal is configured to introduce pressurized fluid into the interface, and includes an annular cavity encircling the radially outward-facing surface of the insert. The cavity forms a portion of a fluid path configured to deliver the pressurized fluid to the interface.

The sealing system may include one or more of the following features: The insert includes at least one radial bore that opens to both the cavity and the interface, and forms another portion of the fluid path. The sealing system includes a first piston ring and a second piston ring. The first and second piston rings are disposed between a radially-outward facing surface of the oil flinger and the insert. The radial bore communicates with the interface at a location between the first piston ring and the second piston ring. The insert includes a radially-extending sealing flange, and the cavity is defined between the bearing housing, the radially outward-facing surface of the insert, and the sealing flange. The sealing flange abuts an axial surface of the bearing housing. The sealing flange is retained in position relative to the bearing housing by a snap ring. The position of the insert relative to the bearing housing is maintained by a snap ring disposed between the insert and a portion of the bearing housing. A supply passageway is in fluid communication with the cavity, the supply passageway forming another portion of the fluid path. An O-ring is disposed in a groove on the radially outward-facing surface of the insert, the O-ring providing a seal between the radially outward-facing surface of the insert and a radially-inward facing surface of the bearing housing.

In some aspects, a turbocharger includes a bearing housing having an axial bore, a turbine stage connected to one end of the bearing housing, a compressor stage connected to an opposed end of the bearing housing, and a rotating assembly. The rotating assembly includes a shaft having axis of rotation and rotatably supported in the axial bore via bearings, a compressor impeller mounted on the shaft, and an oil flinger disposed on the shaft between the bearings and the compressor impeller. The turbocharger further includes an insert disposed in the axial bore so as to surround the oil flinger, the insert defining a radially outward-facing surface. A purge seal is operatively positioned in an interface between the insert and the oil flinger, the purge seal configured to introduce pressurized fluid into the interface; and an annular cavity encircling the radially outward-facing surface of the insert, the cavity forming a portion of a fluid path configured to deliver the pressurized fluid to the purge seal.

The turbocharger may include one or more of the following features: The insert includes at least one radial bore that opens to both the cavity and the interface, and forms another portion of the fluid path. The insert includes a radially-extending sealing flange, and the cavity is defined between the bearing housing, the radially outward-facing surface of the insert, and the sealing flange. A first piston ring and a second piston ring are disposed between a radially outward-facing surface of the oil flinger and the insert, and the radial bore communicates with the interface at a location between the first piston ring and the second piston ring. A supply passageway is in fluid communication with the cavity, the supply passageway forming another portion of the fluid path. The position of the insert relative to the bearing housing is maintained by a snap ring disposed between the insert and a portion of the bearing housing.

Embodiments relate to a sealing system between the backface of the compressor impeller and neighboring components, such as the bearing housing and/or the insert. The sealing system can improve the seal between the dynamic rotating assembly components and the complementary static components on the compressor-end of a turbocharger, thereby minimizing compressor-end oil passage and blow by. As used herein, the term "blow by" refers to high pressure change air (on compressor side) or exhaust gas (on turbine side) leaking into bearing housing and into engine crankcase. The sealing system can include sealing elements such as an external purge gas to enhance a clearance seal. The sealing elements can be operatively positioned at an interface between the rotating assembly and the complimentary static components. The purge seal selectively provides external pressurized gas or internally supplied charge gas (i.e., air) to the interface at the clearance seal to maintain an inward directed pressure gradient regardless of turbocharger operating conditions. The purge seal is supplied with gas via a gas supply path that includes a gas passageway formed in the bearing housing, one or more radial bores formed in an insert of the rotating assembly, and an axisymmetric cavity formed in the bearing housing intermediate to, and in fluid communication with, the gas supply path and the insert's radial bores. The axisymmetric cavity serves as an annular manifold to deliver gas to the insert radial bores, regardless of the orientation of the insert within the bearing housing. It is understood, however, that adding purge gas does not reduce blow-by leakage below the clearance seal's normal capability to prevent blow-by leakage.

Advantageously, the axisymmetric cavity within the gas supply path facilitates fabrication of the passages between the gas supply source and the clearance seal labyrinth volume. For example, passages can be machined at angles that are more convenient for machining and in shorter distances. Moreover, the need for alignment of sequential passage portions is eliminated. The cavity is strategically placed for convenient access to both internal and external purge gas sources, including internal sources from the compressor discharge line by connecting through the diffuser face, and external sources including engine exhaust gas. In some embodiments, parts are integrated to minimize complexity.

BRIEF DESCRIPTION OF THE DRAWINGS

Embodiments are illustrated by way of example and not limitation in the accompanying drawings in which like reference numbers indicate similar parts.

DETAILED DESCRIPTION

Arrangements described herein relate to sealing systems and methods for use between the dynamic rotating assembly components and the complementary static components on the compressor-end of a turbocharger. More particularly, embodiments herein are directed to forming sealing systems that can maintain a positive pressure on the outboard side of a clearance seal (e.g. piston seal rings) interface to prevent oil leakage. Detailed embodiments are disclosed herein; however, it is to be understood that the disclosed embodiments are intended only as exemplary. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations.

Figure 1:
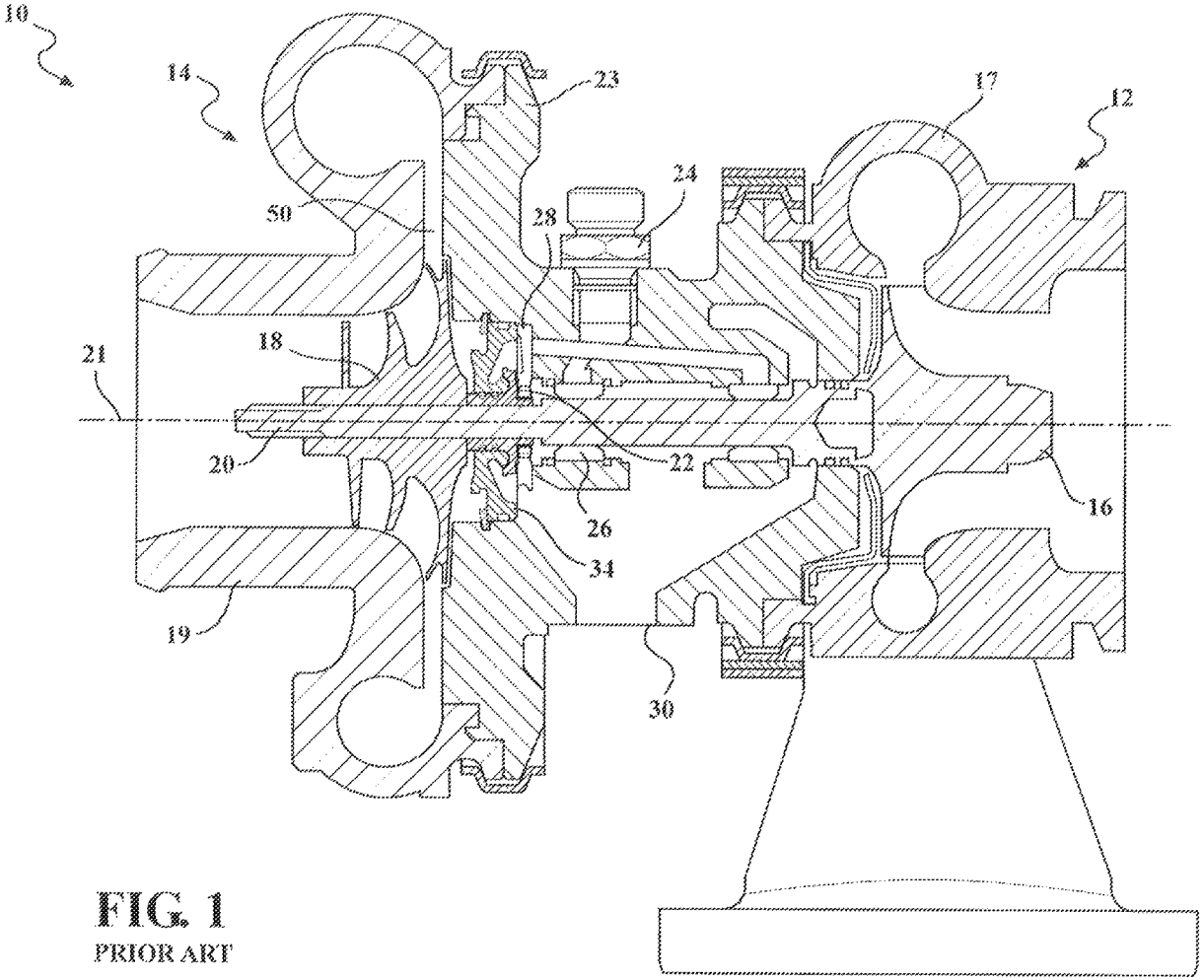
FIG. 1 PRIOR ART
FIG. 1 is a cross-sectional view of a conventional turbocharger.
Figure 2:
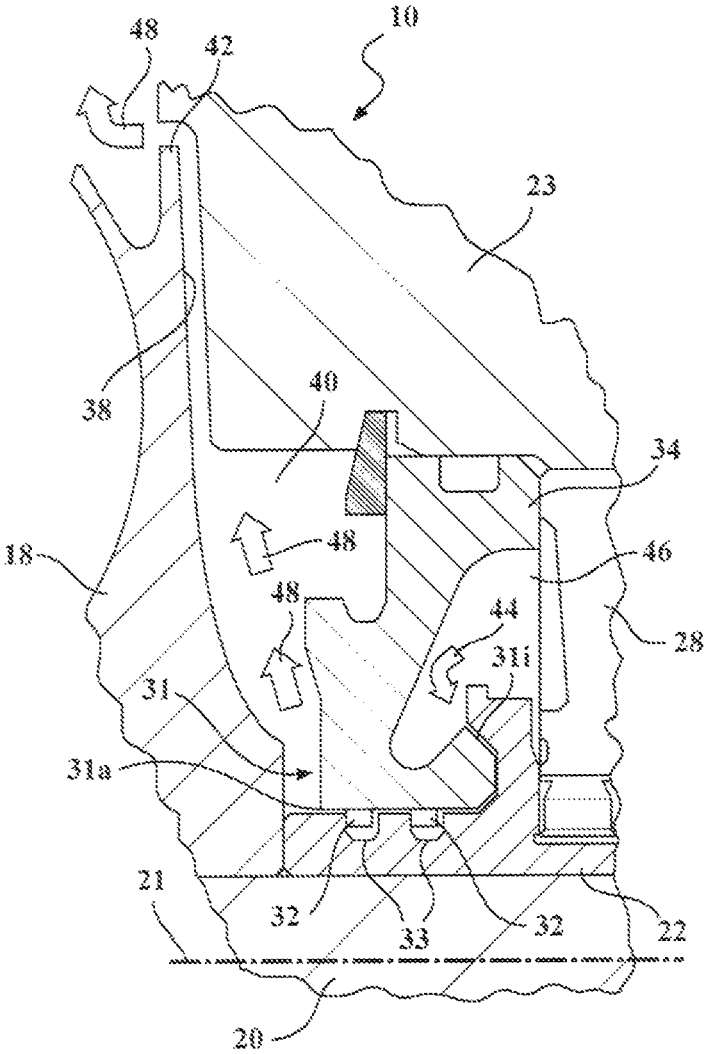
FIG. 2 PRIOR ART
FIG. 2 is an enlarged view of a portion of the compressor-end of the conventional turbocharger of FIG. 1.

Referring to FIGS. 1 and 2, an exhaust gas turbocharger 10 includes a turbine stage 12 and a compressor stage 14. The turbocharger 10 uses the exhaust flow from the exhaust manifold of an engine (not shown) to drive a turbine wheel 16, which is located in a turbine housing 17. Once the exhaust gas has passed through the turbine wheel 16 and the turbine wheel 16 has extracted energy from the exhaust gas, the spent exhaust gas exits the turbine housing 17 through an exducer and is ducted to the vehicle downpipe and usually to after-treatment devices such as catalytic converters, particulate traps, and $NO_x$ traps. The energy extracted by the turbine wheel 16 is translated to a rotational motion that is used to drive a compressor impeller 18, which is located in a compressor housing 19. The compressor impeller 18 draws air into the turbocharger 10, compresses this air, and delivers it to the intake side of the engine. The turbocharger 10 includes a rotating assembly 25 that includes the following major components: a shaft 20, the turbine wheel 16 that is mounted to one end of the shaft 20, the compressor impeller 18 that is mounted on an opposed end of the shaft 20; and an oil flinger 22.

The rotating assembly 25 is supported for rotation about an axis of rotation 21 within a bearing housing 23 disposed between the turbine stage 12 and the compressor stage 14. In particular, the shaft 20 rotates on a hydrodynamic bearing system which is fed a lubricant (e.g. oil typically supplied by the engine). The oil is delivered via an oil feed port 24 to feed both journal bearings 26 and a thrust bearing 28. Upon exiting the bearings, the oil drains to the bearing housing 23 and exits through an oil drain 30 connected to the engine crankcase.

Pressure conditions in the turbine stage 12 and compressor stage 14 can often result in oil being drawn through the sealing mechanisms that seal the rotating assembly to the bearing housing 23. The internal flow of oil from the bearing housing 23 to the backwall 38 of the compressor impeller 18, past the compressor impeller 18, to the compressor stage 14 and engine combustion chamber is generally referred to as "compressor end oil-passage." Compressor-end oil passage is to be avoided as it can result in contamination of the catalysts and unwanted emissions. With ever more stringent emissions standards, the propensity for compressor-end oil passage is becoming a greater issue. In addition to exceeding emission limits or contaminating after treatment systems, oil passage also undesirably coats portions of the turbocharger diffuser and volute, as well as connecting air lines, reducing turbocharger efficiency.

Seals are used within the turbocharger 10 at an interface 31 between one or more static turbocharger elements (e.g. the bearing housing 23 and/or an insert 34) and a portion of the dynamic rotating assembly (e.g., turbine wheel 16, compressor impeller 18, oil flinger 22, and/or shaft 20) to minimize the passage of oil from the bearing housing 23 to the compressor stage 14. Such seals may also prevent the unwanted flow of gas from the compressor stage 14 to the bearing housing 23, a condition known as blowby. For example, one or more clearance seals 32 (e.g. seal rings or piston rings) are operatively positioned between the oil flinger 22 and the insert 34. A portion of each seal 32 can be received within a respective groove 33 provided in the oil flinger 22.

However, during some operating conditions, it may be possible for oil in the bearing housing 23 to pass around the one or more clearance seals 32 and enter the compressor housing 19. One such condition will now be described. There is air in an outboard cavity 40 between the insert 34 and the compressor impeller 18. The compressor impeller 18 rotates at high speed about the axis 21. Air in proximity to the rotating compressor impeller backwall 38 is forced into like-rotation due to the friction between air and the backwall 38. As a result, there can be a centrifugal acceleration (i.e. in the radial direction) which causes there to be a lower pressure in the outboard cavity 40 near the shaft 20 and a higher pressure near the tip 42 of the compressor impeller 18. This pressure gradient is unfavorable with respect to the pressure differential across the interface 31, that is, the pressure on the outboard side 310 is lower than the pressure on the inboard side 31*i*, potentially causing compressor-end oil passage.

In this condition, there is a flow 44 of oil from the inboard cavity 46 between the thrust bearing 28 and the insert 34, around the one or more seal rings 32. This flow 44 is drawn by the forced vortex, as described above, to become a flow 48 behind the compressor impeller backwall 38. This flow 48 is drawn through the compressor stage diffuser 50 (see FIG. 1). In some cases, the effect of this reduced pressure can be counteracted by mechanically recessing the compressor impeller 18 in the bearing housing 23. As a result of this arrangement, some pressurized air from the compressor stage 14 may be diverted to the outboard cavity 40 behind the compressor impeller 18. This diversion of compressed air alters the pressure balance around the outboard cavity 40 from the compressor impeller tip 42 to the one or more seals 32 and minimizes the potential for this oil passage into the compressor discharge and then the combustion system of the engine.

The radial pressure gradient along the compressor back wall can maintain the outboard seal pressure above the inboard seal pressure for most typical operating conditions. However, there are some operating conditions in which it is more difficult or impossible to maintain a positive pressure on the outboard side of the seal including: low or zero turbocharger speed, restricted compressor inlet, exhaust braking or start-up of the low pressure stage in a two stage sequential turbine system. In such cases, it may be possible for oil or other lubricant 44 to pass around the one or more seals 32. Some of these examples will be presented in greater detail below.

When a heavily laden truck, equipped with an engine compression-type exhaust brake, is traveling down a grade with a long steady incline, the exhaust brake can be used to block the flow of exhaust gas downstream of the turbine wheel 16 and provide retardation to the vehicle, independent of the vehicle's wheel brakes. The mass and inertia of the truck can push the truck down the hill, which forces rotation of the engine through the vehicle gearbox. With no fuel being introduced into the engine, the engine acts like an air pump against the blockage of the exhaust brake to retard the velocity of the truck. The mass flow of gas through the turbine stage 12 is greatly reduced, so the rotational speed of the turbocharger shaft 20 is not predominantly driven by the turbine stage 12.

The braking effect of the vehicle on the engine through the vehicle gearbox, which is now acting as an air pump, can generate a depression (e.g. a vacuum in the inlet system as it draws air through the compressor stage 14). The depression in the compressor stage 14 alters the pressure differential at the tip 42 of the compressor impeller 18 across the compressor-end seals 32. This results in an unfavorable pressure differential across the seal rings 32 which can result in compressor-end oil passage. When this exhaust brake-driven situation arises, the depression that has developed can overpower the typically used seal ring pressure differential fixes (e.g. recessing the compressor impeller 18) and cause the passage of oil from the bearing housing 23 into the compressor discharge, and then to the engine combustion system.

A similar problem can occur with the high pressure (HP) compressor stage in staged turbochargers in which the compressors are arranged in series. In a series compressor configuration, the discharge of the low pressure (LP) compressor is ducted directly to the inlet of the HP compressor. When the exhaust mass flow is directed to the turbine stage of the smaller, high pressure HP turbocharger (i.e., not to the larger turbine stage of the LP turbocharger), the compressor stage of the HP compressor can draw more mass flow of air into its inlet than the mass flow output of the potentially larger capacity LP compressor, which is running slowly, with less mass flow output than the mass flow input of the smaller HP compressor. As a result, the compressor stage of the LP compressor is running in a depression, which can result in an unfavorable pressure differential across the compressor-end seal ring of the HP turbocharger.

Figure 3:
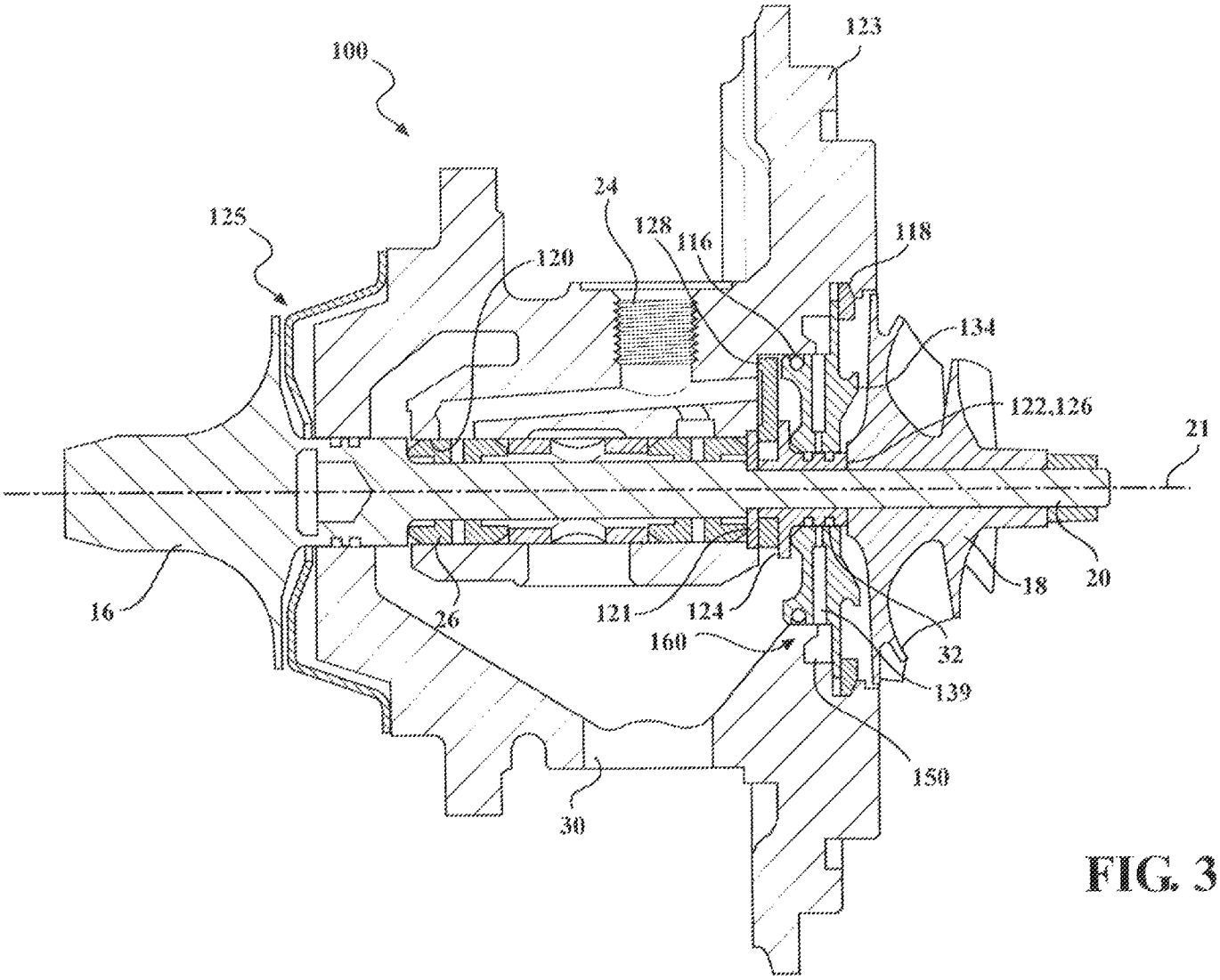
FIG. 3 is a cross-sectional view of a turbocharger including a sealing system.
Figure 4:
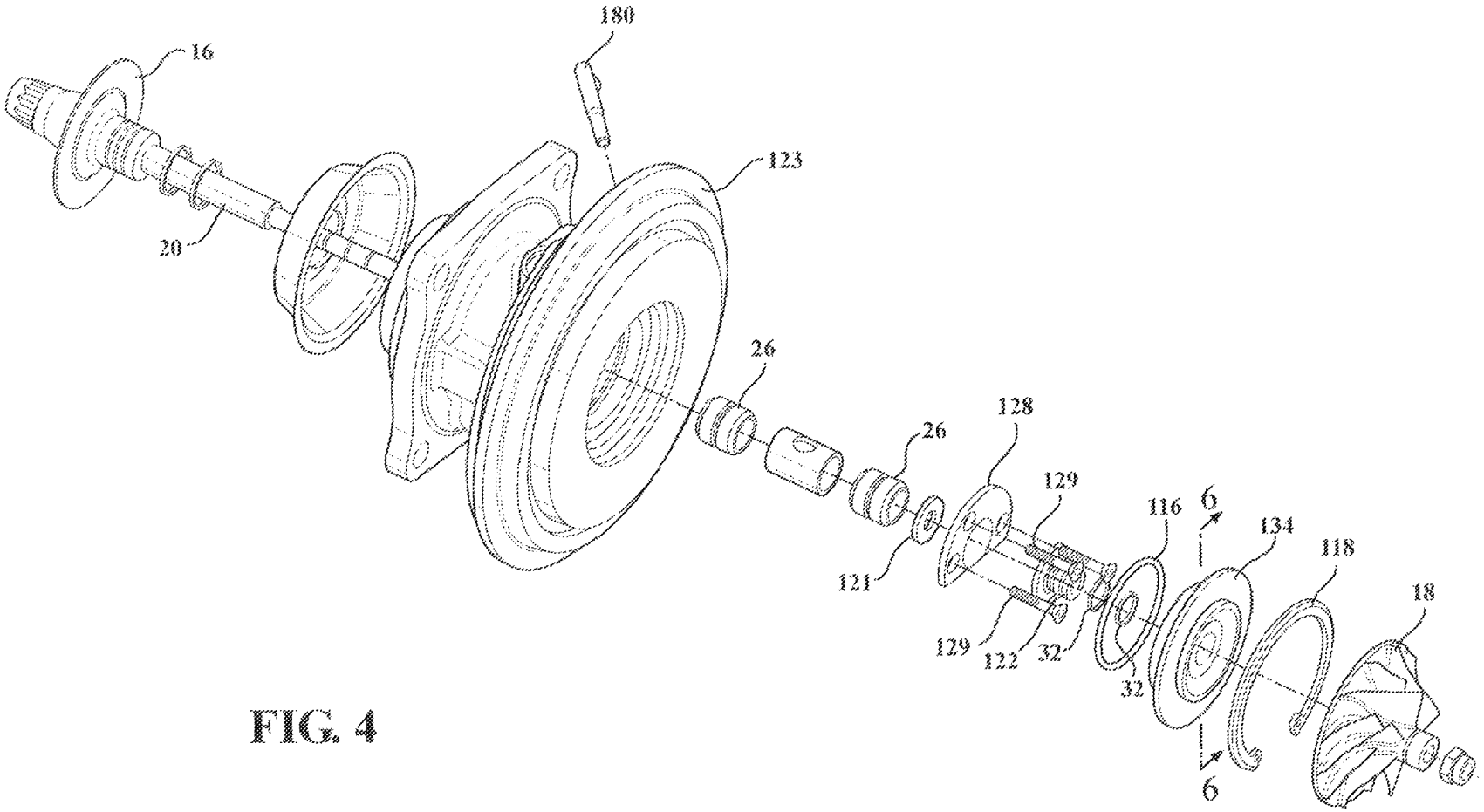
FIG. 4 is an exploded view of a core assembly of the turbocharger of FIG. 3.

Referring to FIGS. 3-4, an exhaust gas turbocharger 100 includes a sealing system 110 that effectively minimizes or prevents compressor-end oil passage and blow by in all operating conditions of the turbocharger 100, as discussed in detail below. The turbocharger 100 is similar to the conventional turbocharger 10 described above. For this reason, common elements are referred to with common reference numbers, and where suitable, the description of common elements is not repeated.

The turbocharger 100 includes a bearing housing 123. The bearing housing 123 is formed having an axially-extending a bore 120 that receives and supports the rotating assembly

125, which includes the shaft 20, the turbine wheel 16, the compressor impeller 18, and an improved oil flinger 122. The rotating assembly 125 is supported for rotation about an axis of rotation 21 via the journal bearings 26 and a thrust bearing 128 that is secured to the bearing housing 123 via bolts 129. Axial loads of the shaft 20 are transferred to the thrust bearing 128 via a thrust washer 121 disposed on an inboard side thereof, and a radially protruding arm 124 of the oil flinger 122 disposed on an opposed, outboard side thereof. An improved insert 134 encircles a cylindrical portion 126 of the oil flinger 122, whereby the insert 134 is disposed adjacent to the compressor-facing side of the thrust bearing 128.

Figure 6:
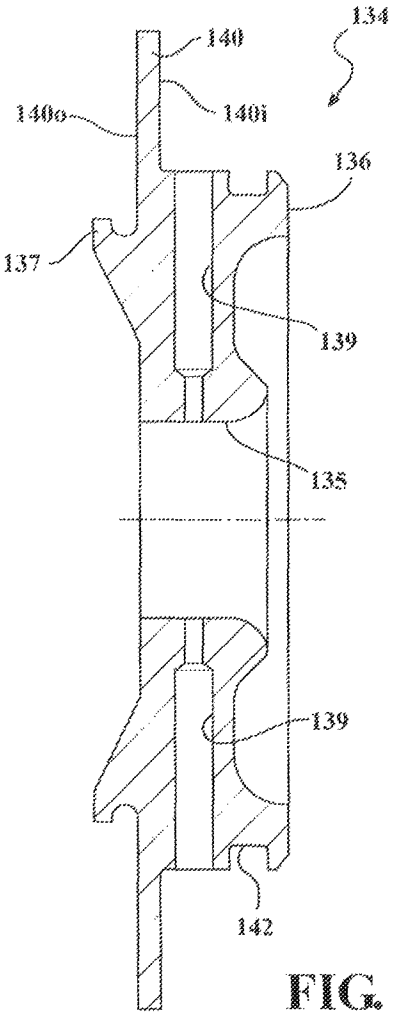
FIG. 6 is a cross-sectional of the insert of FIG. 5.
Figure 5:
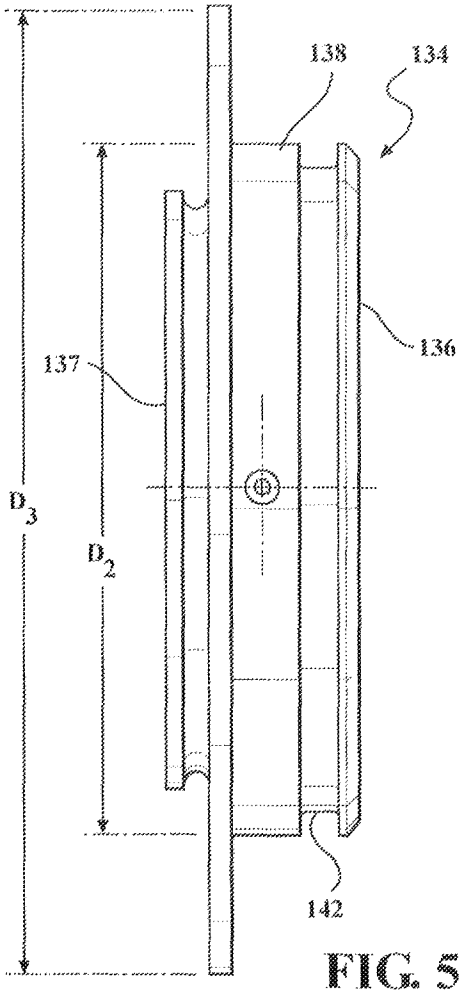
FIG. 5 is a side view of an insert.

Referring to FIGS. 5-6, the insert 134 is generally cylindrical and includes a central, axially-extending opening 135 having sufficient diameter to receive a portion of the oil flinger 122 therethrough. The insert 134 has first, turbine-facing end 136, an opposed compressor-facing end 137, and a radially outward-facing side surface 138 that extends between the turbine-facing end 136 and the compressor-facing end 137. The insert 134 includes at least one radial bore 139 that provides a fluid passage that extends between the side surface 138 and the central opening 135. In the illustrated embodiment, the insert 134 includes two, diametrically opposed radial bores 139, but is not limited to having one or two bores 139. For example, the insert 134 may include 1, 2, 3, 4, 5 or 6 radial bores 139. In some embodiments, the radial bores 139 are equidistantly spaced about the circumference of the insert 134. The insert 134 includes a sealing flange 140 that protrudes radially-outwardly from the side surface 138. The sealing flange 140 is disposed between the radial bores 139 and the compressor-facing end 137. In addition, the insert side surface 138 includes a circumferentially-extending groove 142 that is disposed between the bores 139 and the turbine-facing end 136. The groove 142 is shaped and dimensioned to receive an O-ring 116 therein.

Figure 7:
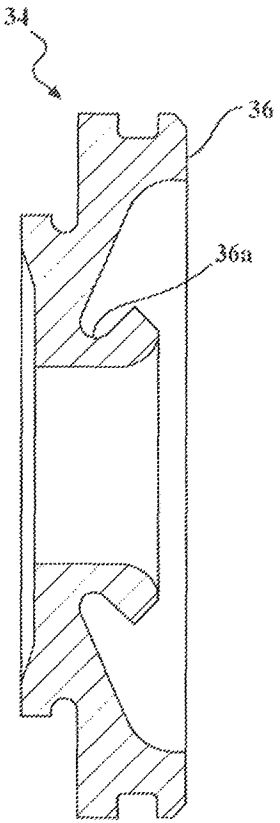
FIG. 7 PRIOR ART
FIG. 7 is a cross-sectional view of a conventional insert.

The differences between the insert 134 used in the turbocharger 100 and the prior art insert 34 used in some conventional turbochargers 10 is best seen in a comparison of FIGS. 6 and 7. In particular, the insert 134 (FIG. 6) is modified relative to some prior art inserts 34 (FIG. 7) in that it includes the radially-extending sealing flange 140 that is configured to engage a portion of the bearing housing 123 (e.g., step S3, discussed below), and includes the radial bores 139, whereas the prior art insert 34 omits these features. In addition, the insert 134 omits an oil drain gutter 36*a* formed on a turbine-facing end 36 of the prior art insert 34. The oil drain gutter 36*a* is no longer required due to implementation of the sealing system 110 including the purge seal 160, and is omitted in the insert 134 to provide a simpler design and improve manufacturing efficiency.

Figure 8:
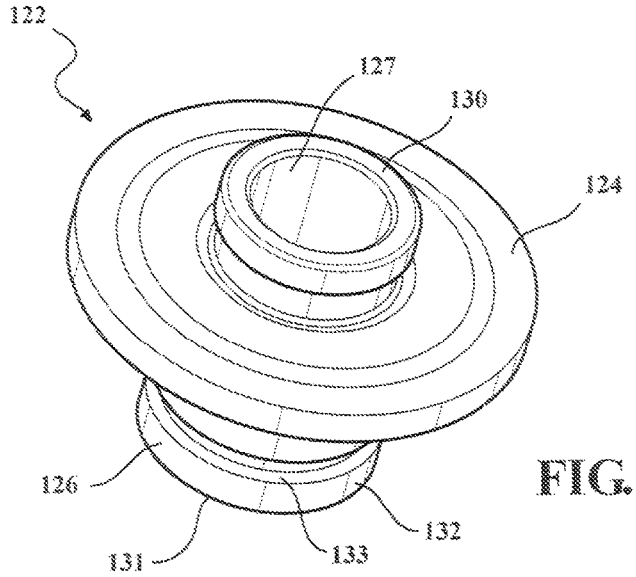
FIG. 8 is a perspective view of an oil flinger.
Figure 9:
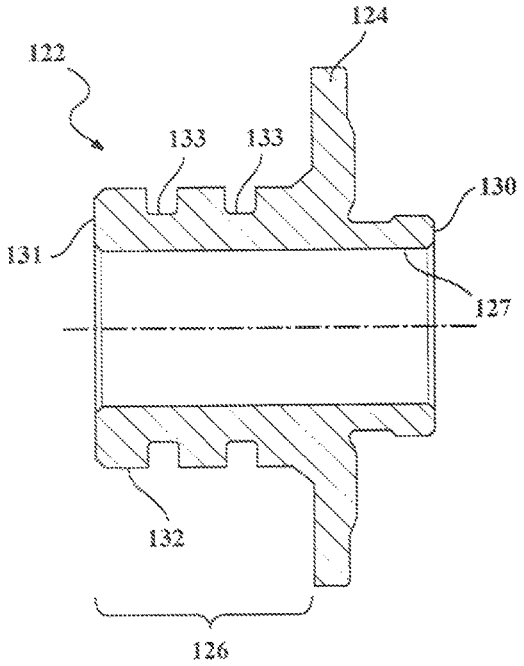
FIG. 9 is a cross-sectional view of the oil flinger of FIG. 8.

Referring to FIGS. 8-9, the oil flinger 122 is generally cylindrical and elongated in the axial direction. The oil flinger 122 includes a central, axially-extending opening 127 having a diameter that corresponds to that of the shaft 20. The oil flinger 122 has first, turbine-facing end 130, an opposed compressor-facing end 131, and a radially outward-facing side surface 132 that extends between the turbine-facing end 130 and the compressor-facing end 137. The oil flinger 122 includes an arm 124 that protrudes radially-outwardly from the side surface 132. The arm 124 is positioned adjacent the turbine-facing end 136, and the portion of the oil flinger 122 disposed between the arm 124 and the compressor-facing end 131 is referred to as the cylindrical portion 126. A pair of circumferentially-extending grooves 133 are formed in the side surface 132 within the cylindrical portion 126. Each of the grooves 133 is configured to receive a piston ring 32 therein.

Figure 10:
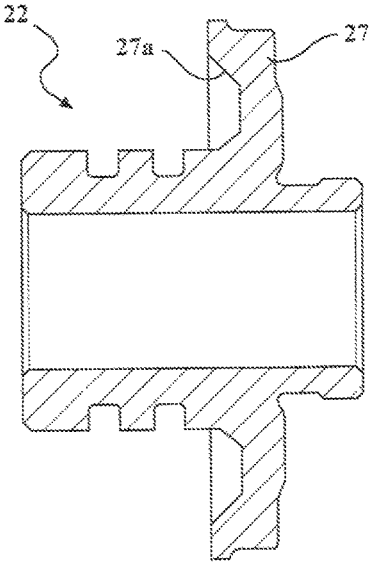
FIG. 10 PRIOR ART
FIG. 10 is a cross-sectional view of a conventional oil flinger.

The differences between the oil flinger 122 used in the turbocharger 100 and the prior art oil flinger 22 used in some conventional turbochargers 10 is best seen in a comparison of FIGS. 9 and 10. In particular, the oil flinger 122 (FIG. 9) is modified relative to some prior art oil flingers 22 (FIG. 10) in that it includes increased axial spacing of the grooves 133 relative to the axial spacing of the grooves 33 of the prior art oil flinger 22. The increased spacing helps to ensure that the purge seal air supply passage, and particularly the radial bore 139 of the insert 134, opens at a location between the grooves 133, and thus also between the piston rings 32. In addition, the oil flinger 122 omits an "overhung" feature 27*a* that is included on the compressor-facing side of the prior art flinger arm 27. The overhung feature 27*a* is no longer required due to implementation of the sealing system 110 including the purge seal 160, and is omitted in the oil flinger 122 to provide a simpler design and improve manufacturing efficiency.

Figure 11:
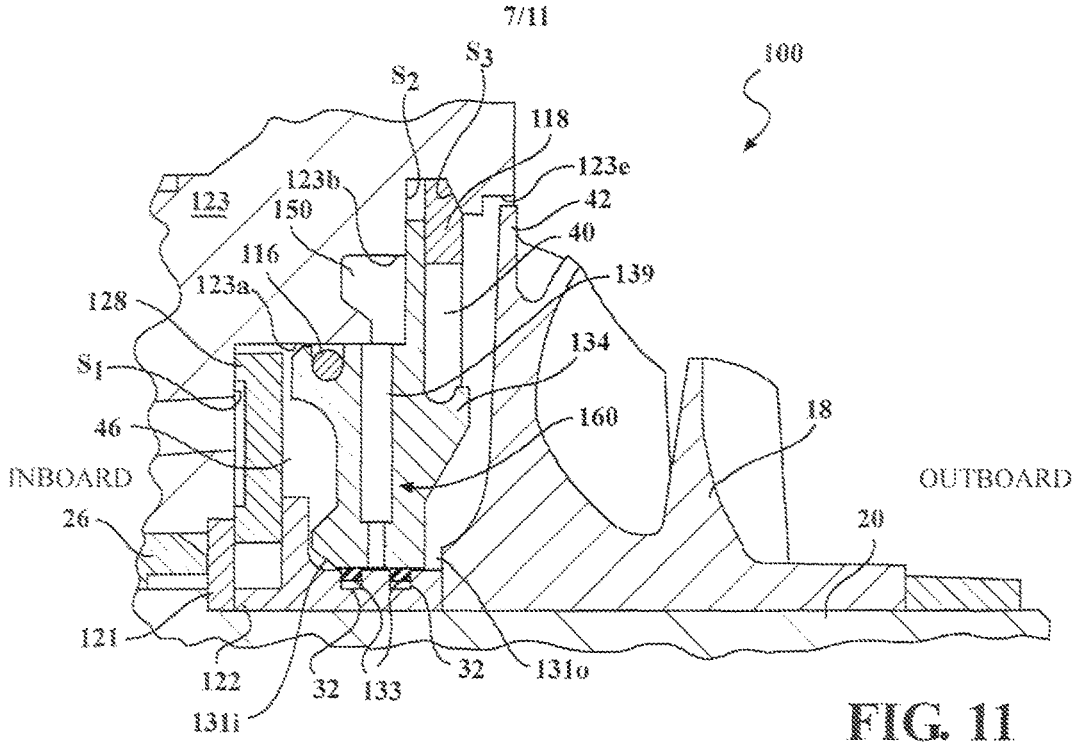
FIG. 11 is an enlarged view of a portion of the compressor-end of the turbocharger of FIG. 3.
Figure 12:
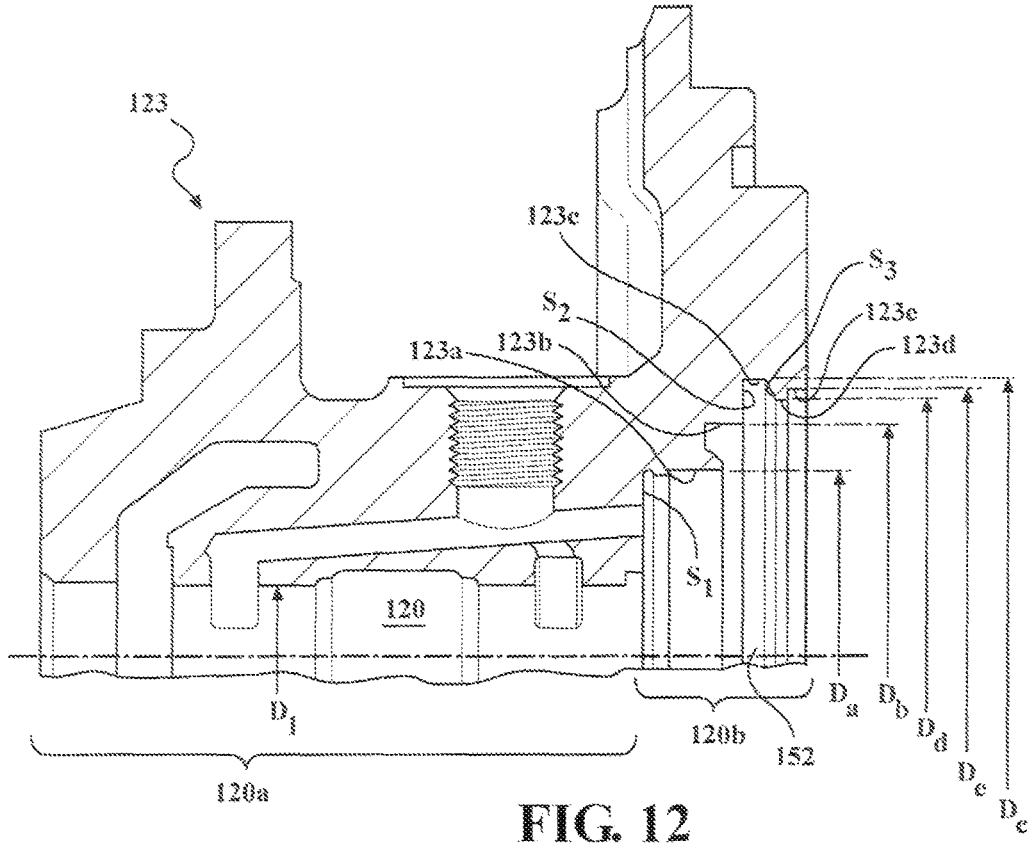
FIG. 12 is an enlarged view of a portion of the compressor-end of the bearing housing of the turbocharger of FIG. 3.

Referring to FIGS. 11 and 12, the bearing housing axial bore 120 includes a journal portion 120*a* that houses the journal bearings 26, and an enlarged diameter portion 120*b* adjacent the compressor-end of the bearing housing 123 that houses the thrust bearing 128, the oil flinger 122, and the insert 134. The enlarged diameter region 120*b* is non-uniform in radial dimension, such that the bearing housing 123 defines a series of annular steps 123*a*, 123*b*, 123*c*, 123*d*, 123*e*, each having a unique diameter that is greater than the diameter D1 of the journal portion 120*a*.

The first annular step 123*a* has a diameter Da. The first annular step 123*a* defines a radially inward-facing surface having an axial dimension sufficient to encircle the thrust bearing 128, the flinger arm 124 and a portion of the insert 134. A first axially-outward, compressor-facing shoulder S1 is formed in the bearing housing 123 at the transition between the journal portion 120*a* and the first annular step 123*a*. The turbine-facing surface of the thrust bearing 128 abuts the first shoulder S1, and axial shaft loads directed toward the turbine end are transferred from the thrust bearing 128 to the bearing housing 123 via the first shoulder S1. In addition, axial loads directed toward the compressor end are transferred to the first shoulder S1 and bearing housing 123 via the bolts 129. Securing the thrust bearing 128 to the first shoulder S1 via the bolts 129 is key to assuring that the thrust bearing 128 are supported as well as that the axisymmetric volume is sealed. This configuration can be compared to some conventional turbocharger bearing systems in which a retaining ring is used to secure the thrust bearing, and in which manufacturing tolerances can create an inconsistent seal force and/or axial bearing force distribution.

The second annular step 123*b* defines a radially inward-facing surface having an axial dimension sufficient to encircle the bores 139. The second annular step has a diameter Db that is greater than the diameter Da of the first annular step 123*a* and the diameter D2 of the insert side surface 138, and is less than the diameter D3 of the insert sealing flange 140. In particular the diameter Da is sufficient so that a radial space exists between the insert side surface 138 and the second annular step 123*b*, whereby an axisymmetric cavity 150 is formed that surrounds a circumference of the insert 134. The second annular step 123*b* is axially located so that the cavity 150 is in fluid communication with the insert radial bores 139.

The third annular step 123*c* defines a radially inward-facing surface and has a diameter Dc that is greater than the diameter Db of the second annular step 123*b* and the diameter D3 of the insert sealing flange 140. A second axially-outward, compressor-facing shoulder S2 is formed in the bearing housing 123 at the transition between second annular step 123*b* and the third annular step 123*c*.

The fourth annular step 123*d* has a diameter Dd that is greater than the diameter Db of the second annular step 123*b* and less than the diameter Dc of the third annular step 123*c*. A third axially-inward, compressor-facing shoulder S3 is formed in the bearing housing 123 at the transition between the third annular step 123*c* and the fourth annular step 123*d*. The third shoulder S3 is axially spaced apart from the second shoulder S2, whereby a circumferentially-extending groove 152 is defined between the second shoulder S2, the third annular step 123*c* and the third shoulder S3. The free end of the insert sealing flange 140 is disposed in the groove 152 with the turbine-facing surface of the insert sealing flange 140 abutting the second shoulder S2. In addition, a C-shaped snap ring 118 is disposed in the groove 152 between the insert sealing flange 140 and the third shoulder. The snap ring 118 serves to retain the insert 134 in the illustrated configuration.

The fifth annular step 123*e* defines a radially inward-facing surface having an axial dimension sufficient to encircle the compressor impeller tip 42. The fourth annular step has a diameter De that is greater than the diameter Dd of the fourth annular step 123*d*. The fourth annular step 123*d* is axially located adjacent the compressor-facing side of the bearing housing 123, and forms a recess that receives the compressor impeller backwall 38 and tip 42.

Figure 13:
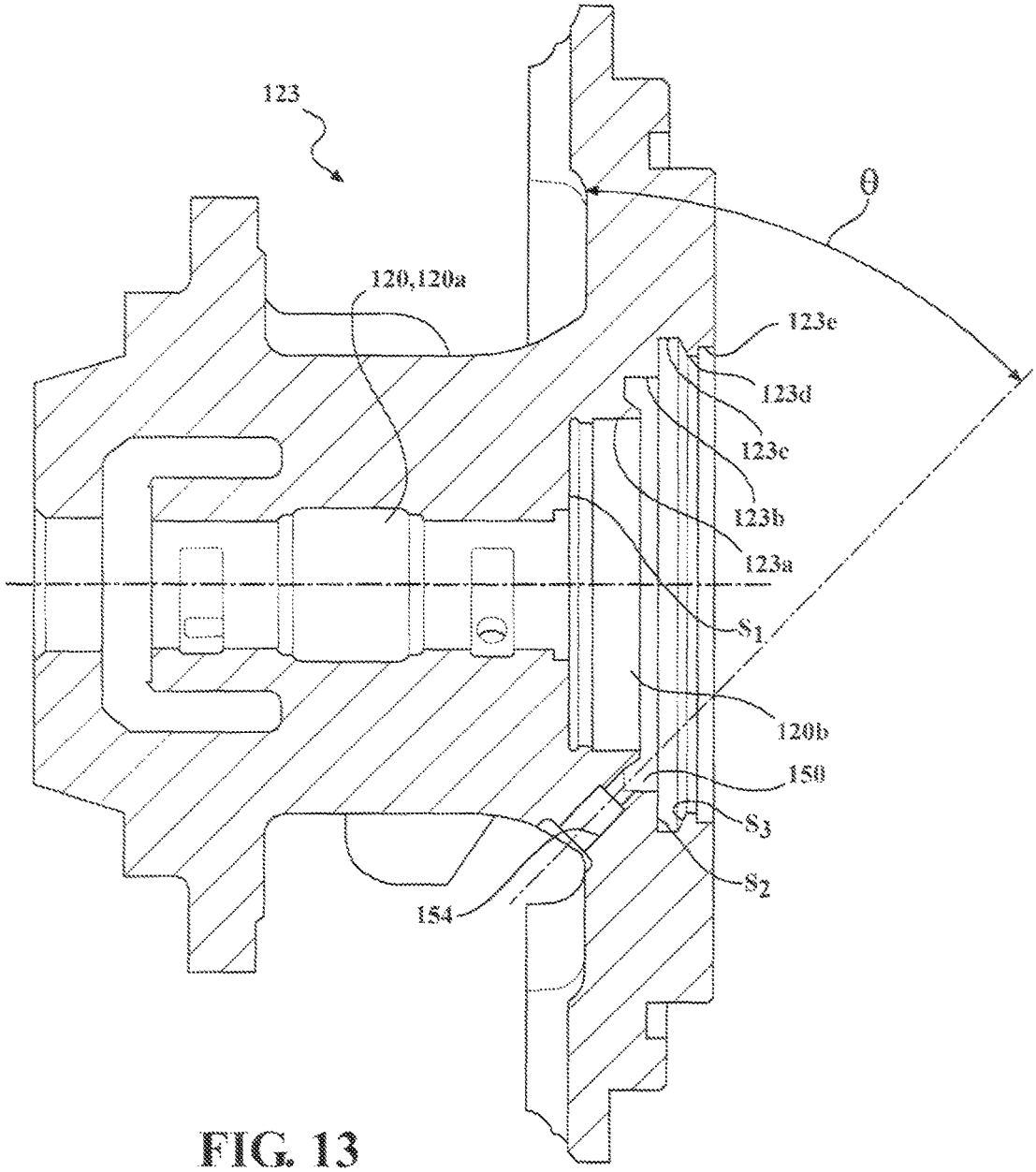
FIG. 13 is a cross-sectional view of the bearing housing of the turbocharger of FIG. 3, where the cross-section of FIG. 13 is taken at an angle relative to the cross-section of FIG. 3.

Referring to FIGS. 11 and 13, in order to prevent compressor-end oil passage and blow by regardless of the operating conditions of the turbocharger 100, the turbocharger 100 includes the sealing system 110 disposed at the compressor end of the bearing housing 123. The sealing system 110 includes the purge seal 160 in combination with a labyrinth or clearance seal (e.g., seal rings or piston rings 32). The sealing elements are operatively positioned at the interface 131 between the rotating assembly 125 and the insert 134.

The piston rings 32 are disposed in the interface 131 between the insert 134 and the oil flinger 122. A portion of each piston ring 32 is received within one of the respective grooves 133 provided in the radially outward-facing side surface 132 of the cylindrical portion 126 of the oil flinger 122.

The purge seal 160 prevents lubricant flow from the bearing housing into the compressor stage by selectively delivering pressurized gas to the interface 131 at a location between the piston rings 32, providing an inward directed pressure gradient across the piston rings 32. It is important that the purge air is between the piston rings as this provides an area with a restriction on both sides of the pressurized air. The purge seal 160 includes a gas supply passageway 154 (FIG. 13) formed in the bearing housing 123, the radial bores 139 formed in the insert 134, and the axisymmetric cavity 150 formed in the bearing housing 123 intermediate to, and in fluid communication with, the gas supply passageway 154 and the radial bores 139. The purge seal 160, including the gas supply passageway 154, the cavity 150, and the radial bores 139, directs pressurized gas to the interface 131.

The gas supply passageway 154 is configured to receive a pressurized fluid that is selectively supplied to the purge seal 160. In the illustrated embodiment, the gas supply passageway 154 is configured to receive an air inlet fitting 180 (FIG. 4), but is not limited to this configuration.

The axisymmetric cavity 150 serves as an annular manifold to deliver gas to the insert radial bores 139, regardless of the orientation of the insert 134 and/or the bores 139 within the bearing housing 123. By providing the annular axisymmetric cavity 150, fabrication of the turbocharger having a purge seal is simplified since the annular cavity 150 is easily fabricated into the compressor end face of the bearing housing 123, and delivers gas to the insert radial bores 139, regardless of the orientation of the insert 134. This can be compared to some conventional turbochargers that included a purge seal gas supply path in which the different parts that included sequential portions of the supply path needed to be accurately fabricated and aligned in order to successfully provide a continuous gas supply path.

The pressure of the inboard side 131*i* of the interface 131 is typically about atmospheric pressure (1 bar), and it can be influenced by the crankcase pressure. The target pressure of the interface volume can be at any suitable pressure so that an inward directed pressure gradient is achieved. In one embodiment, the target pressure at the interface can be from at least about 100 millibars to about 150 millibars greater than the pressure of the inboard side (131*i*).

The supply of air to the interface 131 can be selectively implemented in any suitable manner. For instance, a controller (not shown) can be operatively connected to selectively control the supply of pressurized fluid to the interface 131. The controller can be an engine controller, a turbocharger controller or other suitable controller. The controller can be comprised of hardware, software or any combination thereof.

Air or other purge gas can be selectively supplied to the interface 131 when the pressure on the outboard side 1310 of the interface 131 is at or below a predetermined target pressure. Alternatively or in addition, air or other purge gas can be selectively supplied to the interface 131 when the pressure differential and/or pressure ratio between the outboard side 1310 and the inboard side 131*i* of the interface 131 is at or below a predetermined target ratio or differential. If such conditions occur, air or other purge gas can be supplied to the interface to raise the pressure of the outboard side 1310 to an acceptable level. Examples of operational conditions when such may arise include idle or when the engine is running at light load. Once the predetermined target pressure, differential and/or ratio is achieved, the supply of air to the interface 131 can be discontinued. In this way, air consumption can be minimized, that is, it does not have to be taken from beneficial use elsewhere.

However, it should be noted that, in other implementations and/or in certain operating conditions, the interface 131 may not be selectively pressurized.

Figure 14:
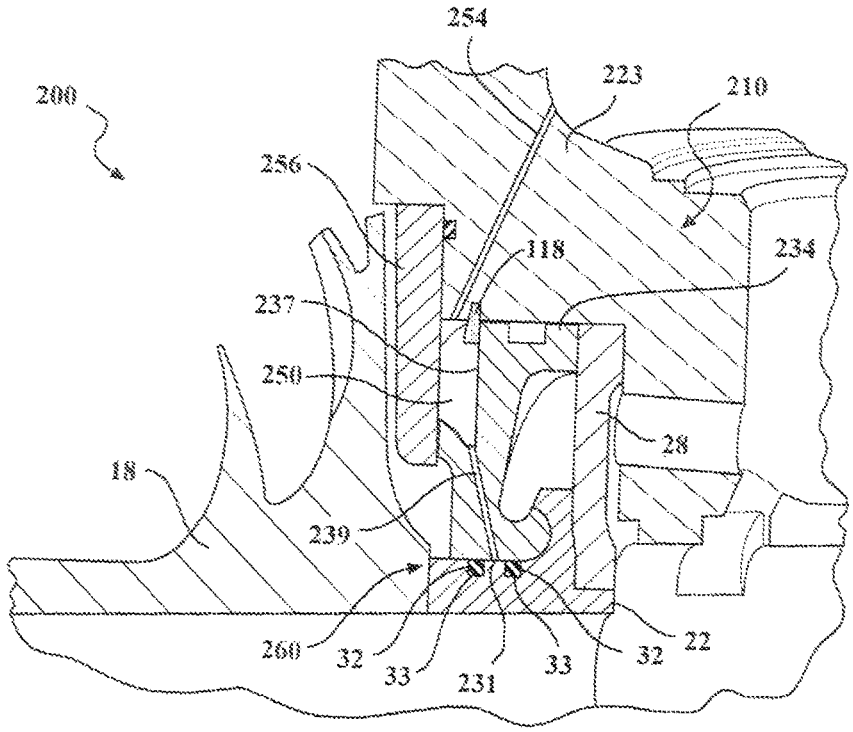
FIG. 14 is a cross-sectional view of a turbocharger including an alternative embodiment sealing system.

Referring to FIG. 14, an alternative sealing system 210 is configured to minimize or prevent compressor-end oil passage and blow by regardless of the operating conditions of a turbocharger 200. The sealing system 210 is disposed at the compressor end of the bearing housing 223, and includes a purge seal 260 in combination with a labyrinth or clearance seal (e.g., seal rings or piston rings 32). The sealing elements are operatively positioned at the interface 231 between the oil flinger 22 of the rotating assembly 125 and the insert 234.

The piston rings 32 are disposed in the interface 231 between the insert 234 and the oil flinger 22. A portion of each piston ring 32 is received within one of the respective grooves 33 provided in the radially outward-facing side surface of the oil flinger 22.

The purge seal 260 prevents lubricant flow from the bearing housing 223 into the compressor stage 14 by selectively delivering pressurized gas to the interface 231 at a location between the piston rings 32, providing an inward directed pressure gradient across the piston rings 32. The purge seal 260 includes a gas supply passageway 254 formed in the bearing housing 223, one or more generally radial bores 239 formed in the insert 234, and the axisymmetric cavity 250 formed in the bearing housing 223 intermediate to, and in fluid communication with, the gas supply passageway 254 and the radial bores 239. The purge seal 260, including the gas supply passageway 254, the cavity 250, and the radial bores 239, directs pressurized gas to the interface 231.

The axisymmetric cavity 250 is defined between the compressor-facing end 237 of the insert 234, a radially-inward facing surface of the bearing housing 223, and an annular axisymmetric volume cover 256. The cover 256 is disposed between the compressor impeller backwall 38 and the insert 234, and is secured to the bearing housing 223 via bolts (not shown). As in the previous embodiment, the axisymmetric cavity 250 serves as an annular manifold to deliver gas to the insert radial bores 239, regardless of the orientation of the insert 234 and/or the bores 239 within the bearing housing 223. This embodiment is also advantageous since it can be made using a conventional bearing housing, insert and flinger.

Figure 15:
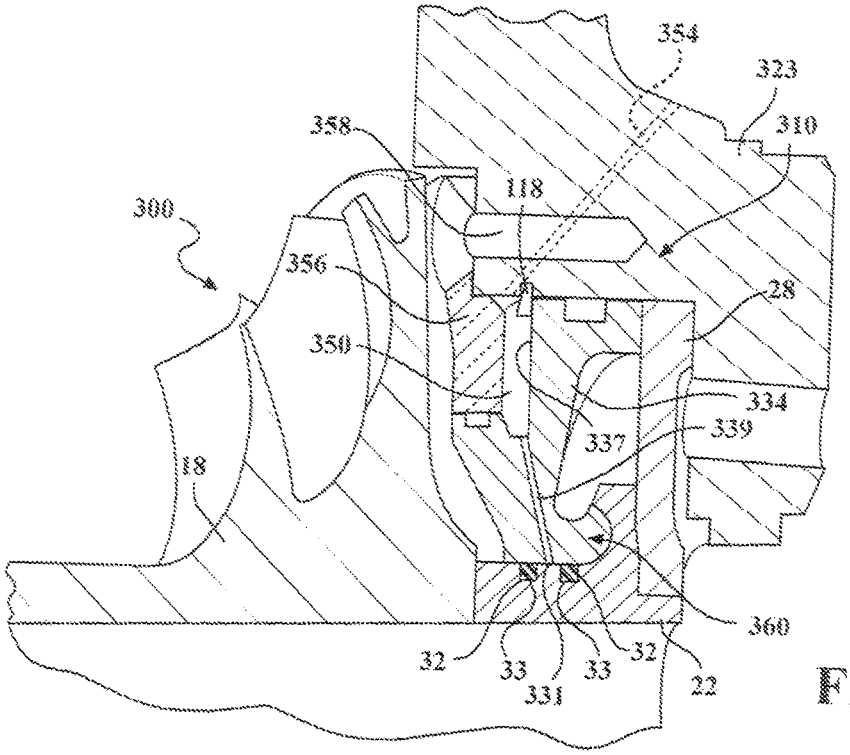
FIG. 15 is a cross-sectional view of a turbocharger including another alternative embodiment sealing system.

Referring to FIG. 15, another alternative sealing system 310 is configured to minimize or prevent compressor-end oil passage and blow by regardless of the operating conditions of a turbocharger 300. The sealing system 310 is disposed at the compressor end of the bearing housing 323, and includes a purge seal 360 in combination with a labyrinth or clearance seal (e.g., seal rings or piston rings 32). The sealing elements are operatively positioned at the interface 331 between the oil flinger 22 of the rotating assembly 125 and the insert 334.

The piston rings 32 are disposed in the interface 331 between the insert 334 and the oil flinger 22. A portion of each piston ring 32 is received within one of the respective grooves 33 provided in the radially outward-facing side surface of the oil flinger 22.

The purge seal 360 prevents lubricant flow from the bearing housing 323 into the compressor stage 14 by selectively delivering pressurized gas to the interface 331 at a location between the piston rings 32, providing an inward directed pressure gradient across the piston rings 32. The purge seal 360 includes a gas supply passageway 354 formed in the bearing housing 323, one or more generally radial bores 339 formed in the insert 334, and the axisymmetric cavity 350 formed in the bearing housing 323 intermediate to, and in fluid communication with, the gas supply passageway 354 and the radial bores 339. The purge seal 360, including the gas supply passageway 354, the cavity 350, and the radial bores 339, directs pressurized gas to the interface 331.

The axisymmetric cavity 350 is defined between the compressor-facing end 337 of the insert 334, a radially-inward facing surface of the bearing housing 323, and an annular axisymmetric volume cover 356. The cover 356 is disposed between the compressor impeller backwall 38 and the insert 334, and is secured to the bearing housing 323 via bolts 358. As in the previous embodiments, the axisymmetric cavity 350 serves as an annular manifold to deliver gas to the insert radial bores 339, regardless of the orientation of the insert 334 and/or the bores 339 within the bearing housing 323. This embodiment is also advantageous since it can be made using a conventional flinger, and includes improved sealing between the insert 334 and the cover 356 relative to the embodiment shown in FIG. 14.

Figure 16:
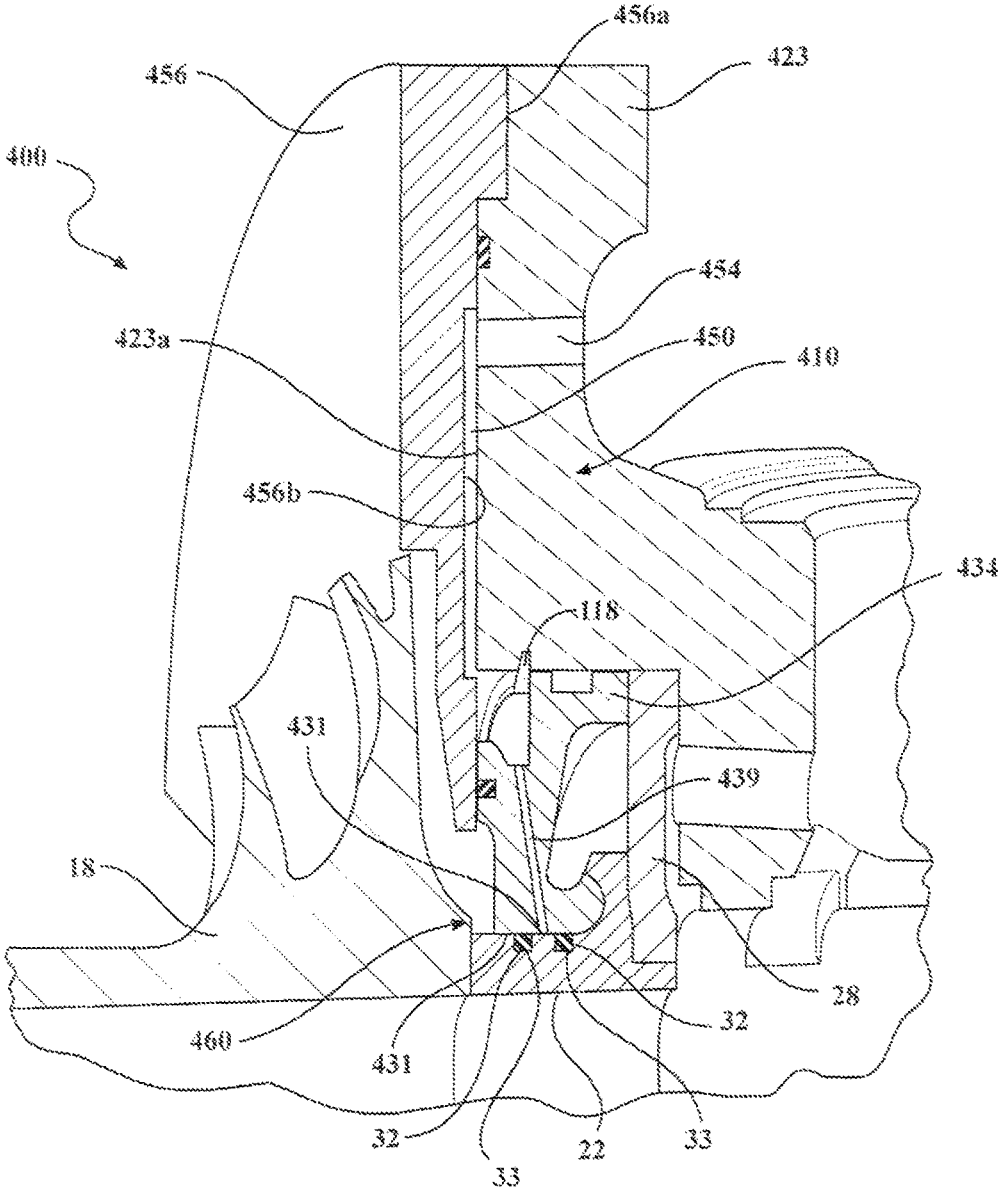
FIG. 16 is a cross-sectional view of a turbocharger including another alternative embodiment sealing system.

Referring to FIG. 16, another alternative sealing system 410 is configured to minimize or prevent compressor-end oil passage and blow by regardless of the operating conditions of a turbocharger 400. The sealing system 410 is disposed at the compressor end of the bearing housing 423, and includes a purge seal 460 in combination with a labyrinth or clearance seal (e.g., seal rings or piston rings 32). The sealing elements are operatively positioned at the interface 431 between the oil flinger 22 of the rotating assembly 125 and the insert 434.

The piston rings 32 are disposed in the interface 431 between the insert 434 and the oil flinger 22. A portion of each piston ring 32 is received within one of the respective grooves 33 provided in the radially outward-facing side surface of the oil flinger 22.

The purge seal 460 prevents lubricant flow from the bearing housing 423 into the compressor stage 14 by selectively delivering pressurized gas to the interface 431 at a location between the piston rings 32, providing an inward directed pressure gradient across the piston rings 32. The purge seal 460 includes a gas supply passageway 454 formed in the bearing housing 423, one or more generally radial bores 439 formed in the insert 434, and an intermediate axisymmetric cavity 450. The purge seal 460, including the gas supply passageway 454, the cavity 450, and the radial bores 439, directs pressurized gas to the interface 431.

The axisymmetric cavity 450 is formed between the bearing housing 423 and an annular axisymmetric volume cover 456 at a location that is radially outward relative to the insert 434. For example, the axially-inward, turbine-facing side **456*a* of the cover 456 may be formed having an annular depression, whereby the cavity 450 is formed between the depressed region 456*b* of the cover 456 and an axially-outward, compressor side-facing surface 423*a* of the bearing housing 423. The cavity 450 is intermediate to, and in fluid communication with, the gas supply passageway 454 and the radial bores 439 of the insert 434. As in the previous embodiments, the axisymmetric cavity 450 serves as an annular manifold to deliver gas to the insert radial bores 439, regardless of the orientation of the insert 434 and/or the bores 439 within the bearing housing 423. This embodiment is also advantageous since it can be made using a conventional flinger, the gas supply passageway 454 can be drilled at any location on the back side of the bearing housing, and bolts (not shown) used to secure the cover 456 to the bearing housing 423** can be installed from the rear of the bearing housing into the outboard surface.

Figure 17:
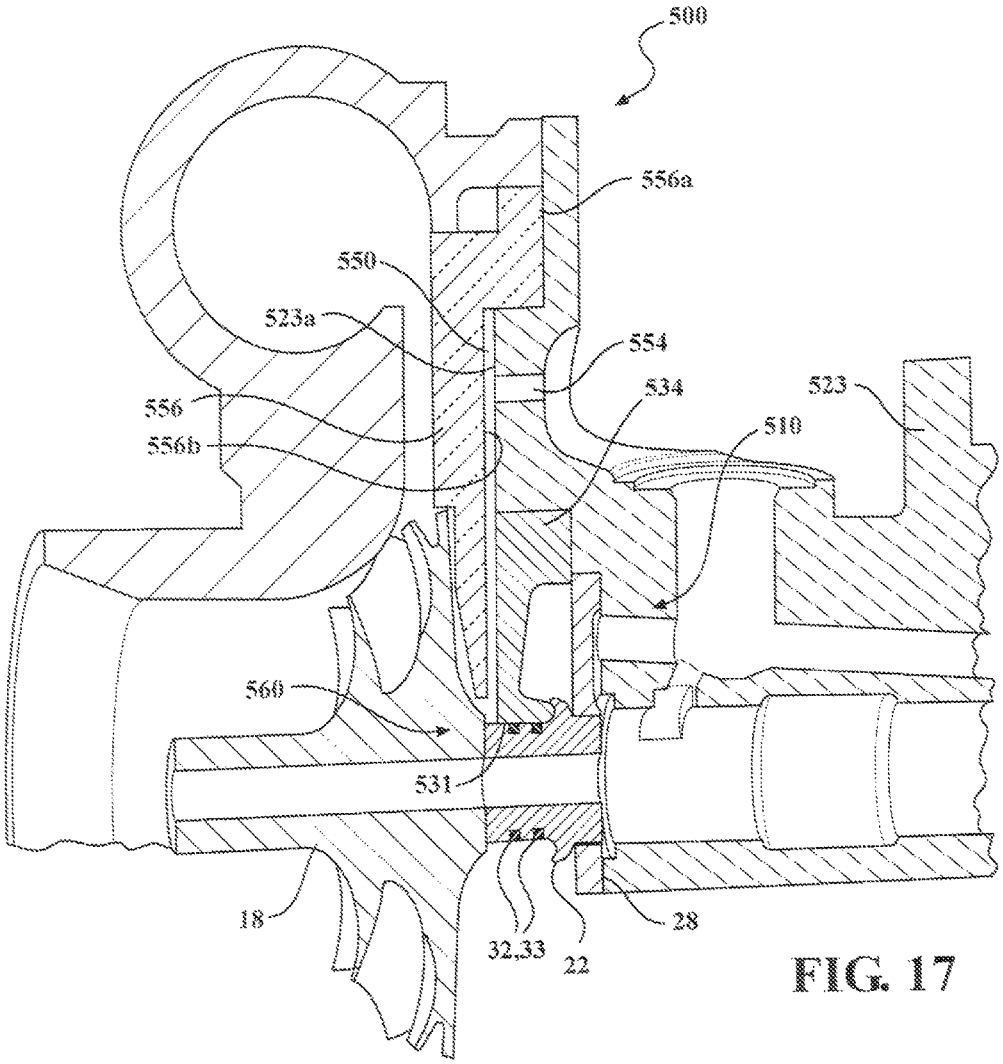
FIG. 17 is a cross-sectional view of a turbocharger including another alternative embodiment sealing system.

Referring to FIG. 17, another alternative sealing system 510 is configured to minimize or prevent compressor-end oil passage and blow by regardless of the operating conditions of a turbocharger 500. The sealing system 510 is disposed at the compressor end of the bearing housing 523, and includes a purge seal 560 in combination with a labyrinth or clearance seal (e.g., seal rings or piston rings 32). The sealing elements are operatively positioned at the interface 531 between the oil flinger 22 of the rotating assembly 125 and the insert 534.

The piston rings 32 are disposed in the interface 531 between the insert 534 and the oil flinger 22. A portion of each piston ring 32 is received within one of the respective grooves 33 provided in the radially outward-facing side surface of the oil flinger 22.

The purge seal 560 prevents lubricant flow from the bearing housing 523 into the compressor stage 14 by selectively delivering pressurized gas to the interface 531 at a location between the piston rings 32, providing an inward directed pressure gradient across the piston rings 32. The purge seal 560 includes a gas supply passageway 554 formed in the bearing housing 523, one or more grooves 539*a*, 539*b* formed in the insert 534, and an intermediate axisymmetric cavity 550. The purge seal 560, including the gas supply passageway 554, the cavity 550, and the grooves 539*a*, 539*b*, directs pressurized gas to the interface 531.

The axisymmetric cavity 550 is formed between the bearing housing 523 and an annular axisymmetric volume cover 556 at a location that is radially outward relative to the insert 534. For example, the axially-inward, turbine-facing side 556*a* of the cover 556 may be formed having an annular depression, whereby the cavity 550 is formed between the depressed region 556*b* of the cover 556 and an axially-outward, compressor side-facing surface 523*a* of the bearing housing 523. The cavity 550 is intermediate to, and in fluid communication with, the gas supply passageway 554 and the grooves 539*a*, 539*b* of the insert 534.

Figure 18:
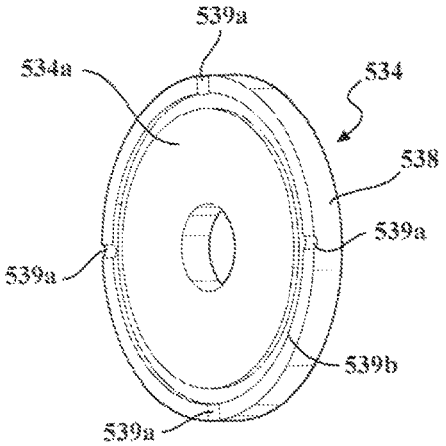
FIG. 18 is a perspective view of the insert of turbocharger of FIG. 17.

Referring to FIG. 18, in this embodiment, the insert 534 is annular and includes a compressor-facing surface 534*a* configured to confront the turbine-facing side 556*a* of the cover 556. In addition, the insert compressor-facing surface 534*a* includes the grooves 539*a*, 539*b* that cooperate with the turbine-facing side 556*a* of the cover 556 to form a portion of the gas supply path. In the illustrated embodiment, the insert compressor-facing surface 534*a* includes four, equidistantly spaced radial grooves 539*a* that extend radially inward from the insert side surface 538, and an annular groove 539*b* that connects each of the radial grooves 539*a*. As in the previous embodiments, the axisymmetric cavity 550 serves as an annular manifold to deliver gas to the insert radial bores 539, regardless of the orientation of the insert 534 and/or the bores 539 within the bearing housing 523. This embodiment is also advantageous since it can be made using a conventional flinger, and since the grooves 539*a*, 539*b* are formed on an outer surface of the insert 534, no radial drilling of the insert 534 is required.

Aspects described herein can be embodied in other forms and combinations without departing from the spirit or essential attributes thereof. For instance, while embodiments described herein are directed to compressor end oil passage, it will be appreciated that such sealing systems and methods can be applied to minimize turbine end oil discharge (i.e., the passage of oil from the bearing housing to the turbine stage). Thus, it will of course be understood that embodiments are not limited to the specific details described herein, which are given by way of example only, and that various modifications and alterations are possible within the scope of the following claims.

What is claimed is:

1. A sealing system (110) for a turbocharger (100) that comprises a bearing housing (123) including an axial bore (120);

a rotating assembly (125) including a shaft (20) having axis of rotation (21), the shaft (20) rotatably supported in the axial bore (120) via bearings (26, 128), a compressor impeller (18) mounted on the shaft (20), an oil flinger (122) disposed on the shaft (20) between the bearings (26, 128) and the compressor impeller (18); and a stationary insert (134) disposed in the axial bore (120) so as to surround the oil flinger (122), the stationary insert (134) defining a radially outward-facing surface (138);

the sealing system (110) including a purge seal (160) operatively positioned in an interface (131) between the stationary insert (134) and the oil flinger (122), the purge seal (160) configured to introduce pressurized fluid into the interface (131), and including an annular cavity (150) encircling the radially outward-facing surface (138) of the stationary insert (134), the cavity (150) forming a portion of a fluid path configured to deliver the pressurized fluid to the interface (131), wherein the stationary insert (134) includes at least one radial bore (139) that opens to both the cavity (150) and the interface (131), and forms another portion of the fluid path.

2. The sealing system (110) of claim 1 comprising a first piston ring (32) and a second piston ring (32), the first and second piston rings (32) disposed between a radially-outward facing surface of the oil flinger (122) and the stationary insert (134), wherein the radial bore (139) communicates with the interface (131) at a location between the first piston ring (32) and the second piston ring (32).

3. The sealing system (110) of claim 1, wherein the stationary insert (134) includes a radially-extending sealing flange (140), and the cavity (150) is defined between the bearing housing (123), the radially outward-facing surface (138) of the stationary insert (134), and the sealing flange (140).

4. The sealing system (110) of claim 3, wherein the sealing flange (140) abuts an axial surface (S2) of the bearing housing (123).

5. The sealing system (110) of claim 4, wherein the sealing flange (140) is retained in position relative to the bearing housing (123) by a snap ring (118).

6. The sealing system (110) of claim 1, wherein the position of the stationary insert (134) relative to the bearing housing (123) is maintained by a snap ring (118) disposed between the stationary insert (134) and a portion of the bearing housing (123).

7. The sealing system (110) of claim 1, including a supply passageway (154) in fluid communication with the cavity (150), the supply passageway (154) forming another portion of the fluid path.

8. The sealing system (110) of claim 1, comprising an O-ring (116) disposed in a groove (142) on the radially outward-facing surface (138) of the stationary insert (134), the O-ring (116) providing a seal between the radially outward-facing surface (138) of the stationary insert (134) and a radially-inward facing surface (123*a*) of the bearing housing (123).

9. A turbocharger (100), comprising a bearing housing (123), the bearing housing (123) including an axial bore (120);

a turbine stage (12) connected to one end of the bearing housing (123);

a compressor stage (14) connected to an opposed end of the bearing housing (123);

a rotating assembly (125) including a shaft (20) having axis of rotation (21), the shaft (20) rotatably supported in the axial bore (120) via bearings (26, 128), a compressor impeller (18) mounted on the shaft (20), and an oil flinger (122) disposed on the shaft (20) between the bearings (26, 128) and the compressor impeller (18);

a stationary insert (134) disposed in the axial bore (120) so as to surround the oil flinger (122), the stationary insert (134) defining a radially outward-facing surface (138);

a purge seal (160) operatively positioned in an interface (131) between the stationary insert (134) and the oil flinger (122), the purge seal (160) configured to introduce pressurized fluid into the interface (131), and including an annular cavity (150) encircling the radially outward-facing surface (138) of the stationary insert (134), the cavity (150) forming a portion of a fluid path configured to deliver the pressurized fluid to the purge seal (160), wherein the stationary insert (134) includes at least one radial bore (139) that opens to both the cavity (150) and the interface (131), and forms another portion of the fluid path.

10. The turbocharger (100) of claim 9, wherein the stationary insert (134) includes a radially-extending sealing flange (140), and the cavity (150) is defined between the bearing housing (123), the radially outward-facing surface (138) of the stationary insert (134), and the sealing flange (140).

11. The turbocharger (100) of claim 9 comprising a first piston ring (32) and a second piston ring (32), the first and second piston rings (32) disposed between a radially outward-facing surface of the oil flinger (122) and the stationary insert (134), wherein the radial bore (139) communicates with the interface (131) at a location between the first piston ring (32) and the second piston ring (32).

12. The turbocharger (100) of claim 9, including a supply passageway (154) in fluid communication with the cavity (150), the supply passageway (154) forming another portion of the fluid path.

13. The turbocharger (100) of claim 9, wherein the position of the stationary insert (134) relative to the bearing housing (123) is maintained by a snap ring (118) disposed between the insert (134) and a portion of the bearing housing (123).

* * * * *